US008019249B2

(12) United States Patent
Kobashi

(10) Patent No.: US 8,019,249 B2
(45) Date of Patent: Sep. 13, 2011

(54) CHARGING DEVICE, IMAGE FORMING APPARATUS AND METHOD OF CHARGING IMAGE CARRIER OF IMAGE FORMING APPARATUS

(75) Inventor: Masaru Kobashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 427 days.

(21) Appl. No.: 12/266,382

(22) Filed: Nov. 6, 2008

(65) Prior Publication Data

US 2009/0123184 A1 May 14, 2009

(30) Foreign Application Priority Data

Nov. 9, 2007 (JP) ..... 2007-291818
Nov. 9, 2007 (JP) ..... 2007-291819
Jul. 14, 2008 (JP) ..... 2008-182516

(51) Int. Cl.
*G03G 15/02* (2006.01)
*G03G 21/00* (2006.01)

(52) U.S. Cl. ..... 399/100; 399/129

(58) Field of Classification Search ..... 399/100, 399/128, 129, 149, 71, 50; 430/108.1
See application file for complete search history.

(56) References Cited

U.S. PATENT DOCUMENTS 5,321,471 A * 6/1994 Ito et al. ..... 399/129
6,381,432 B1 * 4/2002 Hattori ..... 399/100 X
2006/0291903 A1 * 12/2006 Watanabe et al. ..... 399/149
2007/0147905 A1 * 6/2007 Nakano et al. ..... 399/284
2008/0166154 A1 * 7/2008 Watanabe et al. ..... 399/174
2008/0181655 A1 * 7/2008 Sakagawa et al. ..... 399/100

FOREIGN PATENT DOCUMENTS

| | | |
|---|---|---|
| JP | 07-248691 | 9/1995 |
| JP | 10-148998 | 6/1998 |
| JP | 2004-012582 | 1/2004 |
| JP | 2004-117960 | 4/2004 |
| JP | 2005-331846 | 12/2005 |
| JP | 2006-259198 | 9/2006 |
| JP | 2006-343594 | 12/2006 |
| JP | 2007-065591 | 3/2007 |
| JP | 2007-256868 | 10/2007 |

* cited by examiner

*Primary Examiner* — Sophia S Chen
(74) *Attorney, Agent, or Firm* — DLA Piper LLP (US)

(57) ABSTRACT

A charging device includes a first charging member held in contact with an image carrier, a toner image formed thereon, a bias showing a polarity same as that of the charged potential of toner applied thereto, a second charging member arranged downstream relative to the first charging member as viewed in the moving direction of the image carrier and held in contact with the image carrier, a bias showing a polarity opposite to the charged potential of toner applied thereto, a collection member held in contact with the second charging member to collect the toner adhering to the second charging member, a bias being applied thereto and a collection member bias control unit for controlling the bias applied to the collection member according to image forming conditions information.

19 Claims, 6 Drawing Sheets

CHARGING DEVICE, IMAGE FORMING APPARATUS AND METHOD OF CHARGING IMAGE CARRIER OF IMAGE FORMING APPARATUS

CROSS-REFERENCES TO RELATED APPLICATIONS

This application is based upon and claims the benefit of priority from prior Japanese Patent Applications No. 2007-291818, filed Nov. 9, 2007, No. 2007-291819, filed Nov. 9, 2007 and No. 2008-182516, filed Jul. 14, 2008, the entire contents of which are incorporated herein by reference.

BACKGROUND OF THE INVENTION

1. Field of the Invention

This invention generally relates to a charging device for charging a residual toner left on an image carrier after an image transfer operation by means of a first charging member and collecting the charged residual toner by means of a second charging member for charging the image carrier, an image forming apparatus, or an electronic photographic apparatus, such as an electrostatic copying machine, a printer, or a facsimile machine and a method of charging an image carrier of an image forming apparatus.

2. Description of the Related Art

JP-A-2005-331846 (to be referred to as Document 1 hereinafter) and JP-A-2004-12582 (to be referred to as Document 2 hereinafter) propose an image forming apparatus having a charging device prepared by combining first and second charging members for charging an image carrier where an electrostatic latent image and a toner image are formed.

An image forming apparatus described in Document 1 is designed to remove the residual toner adhering to a photosensitive member after an image transfer operation by scraping it off by means of a photosensitive member cleaning brush. However, the toner, if of a small quantity, that is not scraped off from the photosensitive member by the photosensitive member cleaning brush then adheres to a charging roller, which is a second charging member for electrically charging the photosensitive member, to contaminate the charging roller. Then, it is difficult to desirably charge the photosensitive member. To avoid this problem, the polarity of the bias applied to the charging roller for the purpose of forming an image is subsequently inverted in order to remove the contaminant adhering to the charging roller, which is a second charging member, in the image forming apparatus described in Document 1. With this arrangement, the surface potential of the photosensitive member can be stabilized for a long period of time so that high quality images can be obtained without disturbances.

When, however, toner containing an external additive to a high ratio is employed in such an image forming apparatus, the external additive can easily escape the cleaning blade and remain on the charging roller. The external additive does not escape uniformly in the longitudinal direction of the cleaning blade. In other words, it may escape to a large extent in some local areas and but only to a small extent in some other local areas. In the local areas where the external additive escapes the cleaning blade to a large extent, the above-described technique of applying a bias of the opposite polarity to the charging roller does not provide an effect of sufficiently cleaning the photosensitive member and can unevenly smear the charging roller, which is a second charging member. Thus, it is then difficult to satisfactorily charge the photosensitive member by means of the second charging member and the photosensitive member can be defectively charged.

The first charging member of an image forming apparatus described in Document 2 is realized by using a brush roller and the apparatus is designed to remove the toner showing a positive polarity or the toner showing the opposite polarity and adhering to the photosensitive member after a transfer operation and the discharge products that are made to adhere to the photosensitive member when the photosensitive member is charged by the charging roller, which is a second charging member, in order to prevent those foreign objects from adhering to the surface of the charging roller of the photosensitive member. With this arrangement, the surface potential of the photosensitive member can be stabilized for a long period of time so that high quality images can be obtained without disturbances.

However, the brush roller, or the first charging roller, of an image forming apparatus described in Document 2 is designed to temporarily seize the foreign objects from the photosensitive member. Thus, as the quantity of the foreign objects that are seized by the brush roller increases, they are transferred onto the photosensitive member again and removed by way of a transfer unit. Therefore, such foreign objects are deposited on the surface of the photosensitive member in the long run. The foreign objects that are adhering to the photosensitive member after the transfer include those that cannot be seized by the brush roller so that such foreign objects can be further deposited on the surface of the photosensitive member. Thus, it is then difficult to satisfactorily charge the photosensitive member by means of the charging roller, which is a second charging member, and the photosensitive member can be defectively charged.

SUMMARY OF THE INVENTION

An object of the present invention is to provide a charging device, an image forming apparatus and a method of charging an image carrier of an image forming apparatus that can effectively remove foreign objects including the residual toner remaining after a transfer operation and the discharge product produced in a charging operation from the image carrier and satisfactorily charge the image carrier.

The above object of the invention is achieved by providing a charging device, an image forming apparatus and a method of charging an image carrier that develop an electrostatic latent image of an image carrier by means of toner formed by adding external additive to toner mother particles to produce a toner image on the image carrier. The toner image on the image carrier is then transferred onto a transfer medium. After transferring the toner image on the image carrier, the residual toner left after the transfer operation and foreign objects including discharge products produced as a result of a charging operation remain on the image carrier. The foreign objects are then electrically charged by a first charging member to which a voltage showing a polarity same as that of the charged potential of the foreign objects is applied. The foreign objects on the image carrier that are electrically charged by the first charging member are then caught and collected by a second charging member bearing a voltage applied thereto with a polarity opposite to that of the charged potential of the foreign objects. As a result, the residual toner left after the transfer operation and adhering to the second charging member and part of the toner mother particles and also part of the external additive are collected by a collection member bearing a controlled bias applied thereto and the foreign objects adhere to the second charging member by a predetermined constant quantity after the passage of the collection member.

The bias that is applied to the collection member is controlled according to image forming unit service life information by a collection member bias control unit.

Image forming unit service life information may typically include image carrier service life information and toner cartridge information. Image carrier service life information may by turn include information on the number of sheets printed by the image forming unit. As the number of sheet printed by the image forming apparatus increases with time, the cleaning performance and the charging performance of the second charging member will be degraded partly because the brush brittles are worn. Therefore, when the number of sheets printed by the image forming apparatus exceeds a predefined number, the bias to be applied to the collection roller is set to a relatively high level. Conversely, when the number of sheets printed by the image forming apparatus is smaller than the predefined member, the bias to be applied to the collection roller is set to a relatively low level. Thus, the external additive can be made to adhere to the second charging member by a predetermined constant quantity by controlling the bias of the collection roller according to information on the number of sheets printed by the image forming unit.

Toner cartridge information may typically include information on the quantity of toner remaining in the toner cartridge. When the quantity of toner remaining in the toner cartridge exceeds a predefined level probably because the toner cartridge is still full, the external additive may be isolated already or readily from toner mother particles to a large extent so that the bias to be applied to the collection roller is set to a relatively high level. Conversely, when the quantity of toner remaining in the toner cartridge is lower than the predetermined level probably because toner is consumed to a large extent, the bias to be applied to the collection roller is set to a relatively low level. Thus, the external additive can be made to adhere to the second charging member by a predetermined constant quantity by controlling the bias of the collection roller according to information on the quantity of toner remaining in the toner cartridge.

The bias to be applied to the collection roller is controlled according to image forming conditions information by a collection member bias control unit.

Image forming conditions information may typically include development bias information defined on the basis of a patching operation and printing density information. The development bias is determined according to a patching operation in an image forming apparatus and development bias information is information on the determined development bias. More specifically, the external additive can easily move onto the image carrier when a value higher than a predetermined level is selected for the development bias. Then, a relatively high value is selected for the bias to be applied to the collection roller. Conversely, the external additive can hardly move onto the image carrier when a value lower than a predetermined level is selected for the development bias. Then, a relatively low value is selected for the bias to be applied to the collection roller. In this way, the external additive can be made to adhere to the second charging member by a predetermined constant quantity by controlling the bias of the collection roller according to information on the development bias defined on the basis of a patching operation.

Printing density information is information accumulated so far on the printing density in the printing operations performed in the past. More specifically, the rate of supply of toner is high when information accumulated so far on the printing density in the printing operations performed in the past indicates a density higher than a predefined printing density level. Then, a relatively high value is selected for the bias to be applied to the collection roller. Conversely, the rate of supply of toner is low when information accumulated so far on the printing density shows a density lower than a predefined printing density level. Then, a relatively low value is selected for the bias to be applied to the collection roller. In this way, the external additive can be made to adhere to the second charging member by a predetermined constant quantity by controlling the bias of the collection roller according to printing density information.

Then, the image carrier is electrically charged by the second charging member that is held in contact with the image carrier. Since the external additive is adhering to the second charging member, it is forced to slide on the surface of the image carrier. As the external additive is forced to slide on the surface of the image carrier, the foreign objects such as the discharge products and the residual toner deposited on the surface of the image carrier are scraped off. Then, as a result, the image carrier can be more uniformly charged with electricity. Thus, the image forming apparatus can provide an excellent image quality over a prolonged period of time.

When an external additive that provides a polishing effect is added to toner mother particles, the foreign objects such as the discharge products and the residual toner deposited on the surface of the image carrier are effectively scraped off. Additionally, when an external additive that provides a charging assisting effect is added to toner mother particles, the external additive having a charging assisting effect is made to adhere to the second charging member by a predetermined constant quantity after passing the collection member. Then, as a result, the image carrier can be more uniformly charged with electricity. Thus, the image forming apparatus can provide an excellent image quality over a prolonged period of time.

BRIEF DESCRIPTION OF THE DRAWINGS

The present invention will be described below in greater detail with reference to the accompanying drawings, wherein like numbers refer to like elements.

DESCRIPTION OF EXEMPLARY EMBODIMENTS

Now, exemplary embodiments of the present invention will be described in greater detail below by referring to the accompanying drawings.

Figure 1:
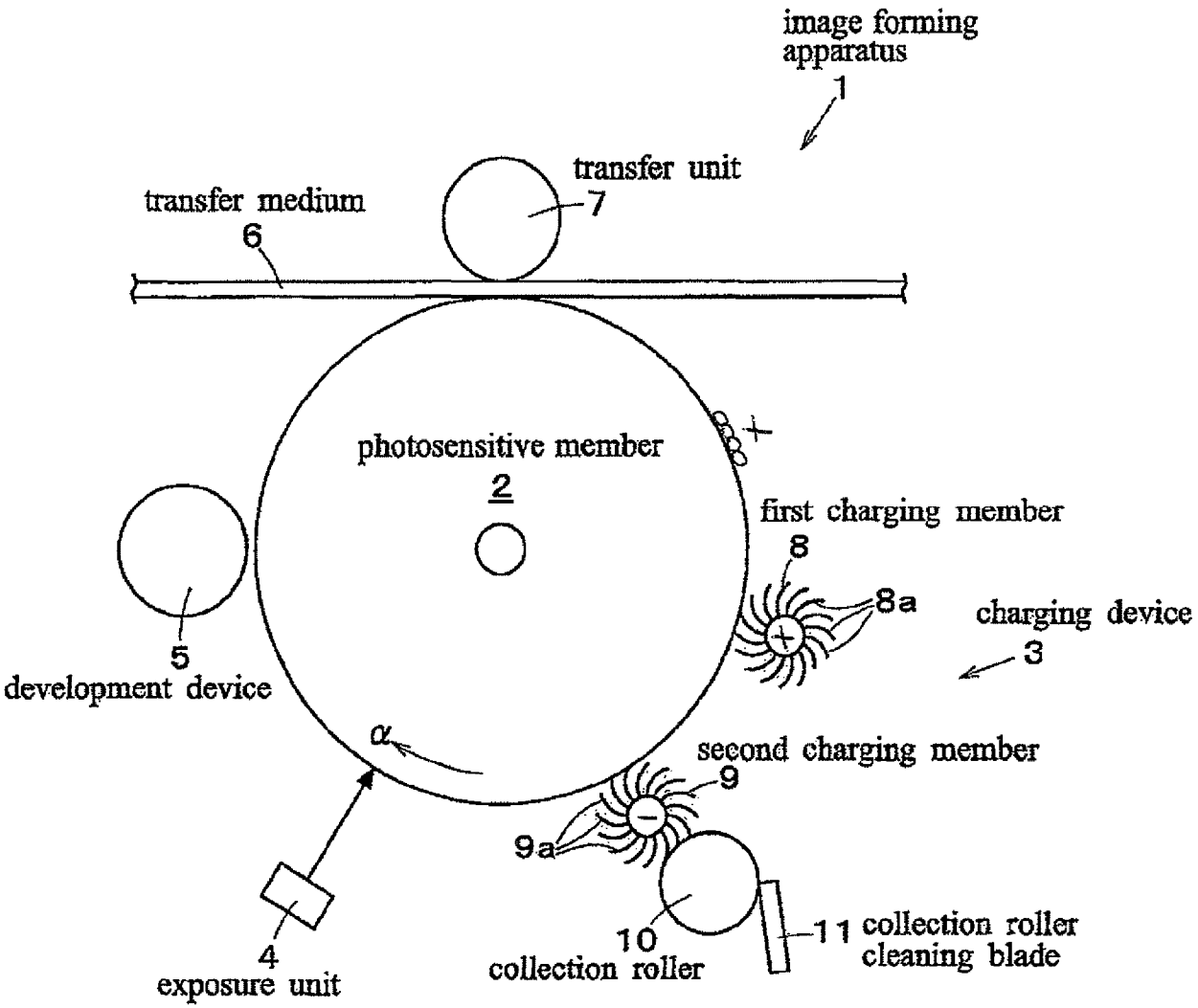
FIG. 1 is a schematic partial view of image forming apparatus according to a first embodiment of the present invention.

FIG. 1 is a schematic partial view of image forming apparatus according to the first embodiment of the present invention.

As shown in FIG. It the image forming apparatus 1 according to the first embodiment has a photosensitive member 2 that is an image carrier where an electrostatic latent image and an toner image are formed. A charging device 3 is arranged near the outer periphery of the photosensitive member 2 to electrically charge the photosensitive member 2. Additionally, an exposure unit 4 for writing an electrostatic image on the photosensitive member 2, a development unit 5 for developing the electrostatic latent image on the photosensitive member 2 and a transfer unit 7 for transferring the toner image on the photosensitive member 2 onto a transfer medium 6, which may by a sheet of transfer paper or an intermediate transfer medium, are arranged near the outer periphery of the photosensitive member 2 downstream relative to the charging device 3 sequentially in the mentioned order in the sense of rotation a of the photosensitive member 2. Note that the photosensitive member 2 is not provided with a photosensitive member cleaning unit that is dedicated to the photosensitive member 2 to collect the foreign objects including the residual toner adhering to the photosensitive member 2 after a transfer operation. Although not shown, the image forming apparatus 1 of the first embodiment is also provided with a fixation unit, a sheets of transfer paper conveying unit, a sheets of transfer paper containing cassette, and, when the transfer medium 6 is an intermediate transfer medium, a transfer unit for transferring the toner image on the intermediate transfer medium onto a sheet of transfer paper as in the case of ordinary image forming apparatus.

The photosensitive member 2 of this first embodiment is a photosensitive drum that has a photosensitive layer of a predetermined thickness on the outer peripheral surface of a cylindrical metal plain tube as in the case of ordinary photosensitive drums. The metal plain tube of the photosensitive member 2 is an electro-conductive tube typically made of aluminum and the photosensitive layer is made of a known organic photosensitive material as in the case of known image forming apparatus, although a photosensitive member other than a photosensitive drum may be used for the photosensitive member 2.

The charging device 3 of the first embodiment includes a first charging member 8 arranged downstream relative to the transfer unit 7 in the sense of rotation a of the photosensitive member 2 so as to be held in contact with the photosensitive member 2, a second charging member 9 arranged downstream relative to the first charging member 8 in the sense of rotation a of the photosensitive member 2 so as to be held in contact with the photosensitive member 2, a collection roller 10 that is a collection member held in contact with the second charging member 9 to collect toner by a predetermined constant quantity and a collection roller cleaning blade 11 for removing the toner collected by the collection roller 10.

The first charging member 8 is a brush roller that is a charging brush member. The first charging member 8 is so designed as to electrically charge the residual toner left on the photosensitive member 2 after a transfer operation by means of the brush brittles 8*a* as a bias (DC voltage) that is not lower than the discharge triggering voltage (Vth) of a polarity same as the charged potential of the toner is applied to it.

The second charging member 9 is also a brush roller that is a charging brush member for charging the photosensitive member 2. The second charging member 9 is so designed as to electrically charge the photosensitive member 2 and seize and collect the residual toner left after a transfer operation on the photosensitive member 2 that is electrically charged by the first charging member 8 as a bias (DC voltage) of a polarity opposite to the charged potential of the toner is applied to it.

Figure 2:
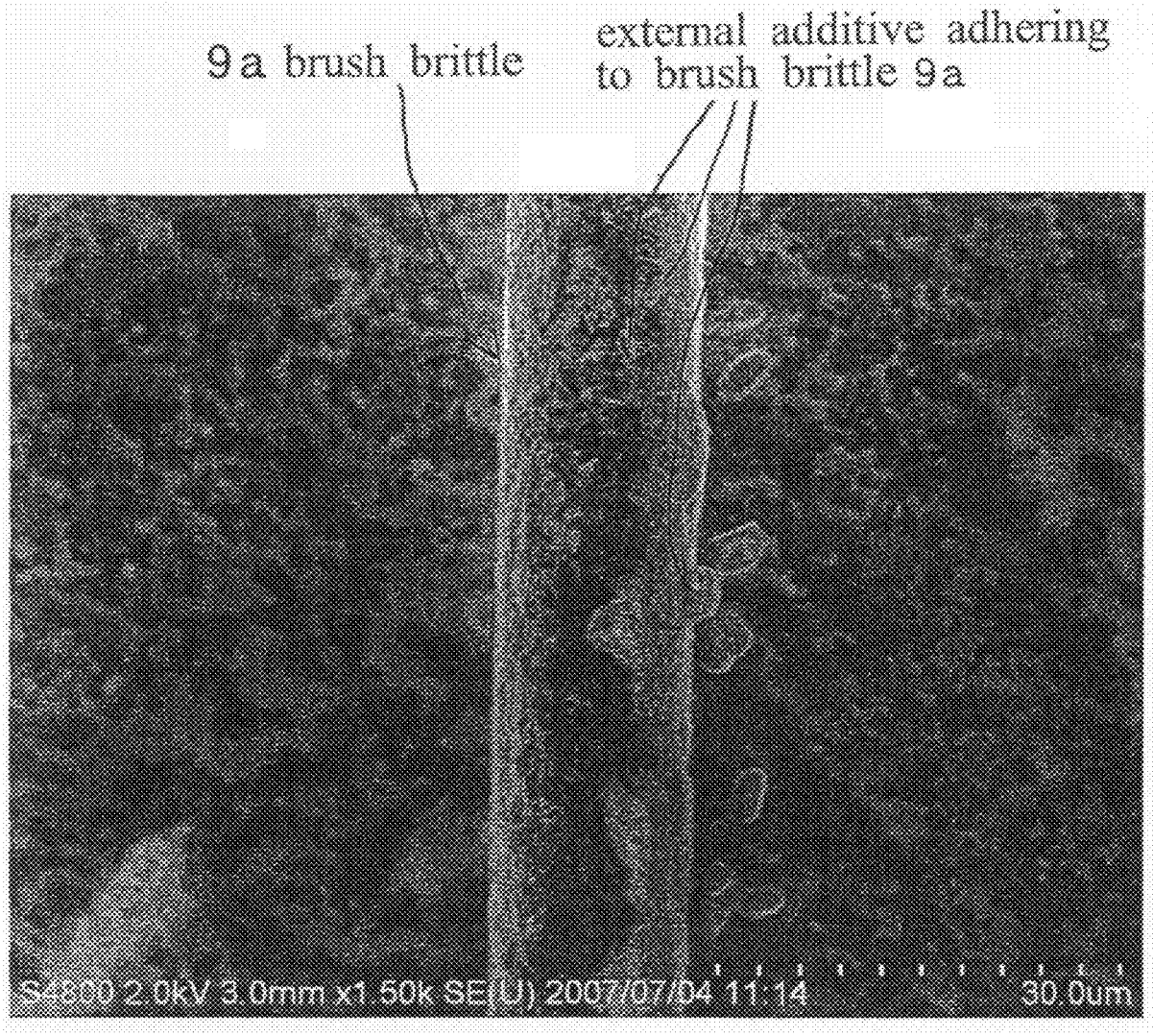
FIG. 2 is an enlarged schematic microscopic view of a brittle of the second charging member, showing the external additive adhering to it.

Furthermore, a bias (DC voltage) is also applied to the collection roller 10. By controlling the bias applied to the collection roller 10, it partly collects the toner mother particles and the external additive of the residual toner left after a transfer operation that is seized and collected by the brush brittles 9*a* of the second charging member 9 and adhering to the latter. As shown in FIG. 2, the external additive adheres to the brush brittles 9*a* of the second charging member 9 after passing by the collection roller 10. The quantity by which the external additive adheres to the second charging member 9 is controlled by controlling the bias to be applied to the collection member 10 so as to make a predetermined constant quantity of the external additive adhere to brush brittles 9*a* of the second charging member 9. With this arrangement, the external additive that provides a charging assisting effect is made to adhere to the second charging member 9 by a predetermined constant quantity after passing by the collection roller 10.

The bias to be applied to the collection roller 10 is controlled by the collection roller bias control unit that is a collection member bias control device according to information image forming unit service life information or image forming conditions information.

Figure 3:
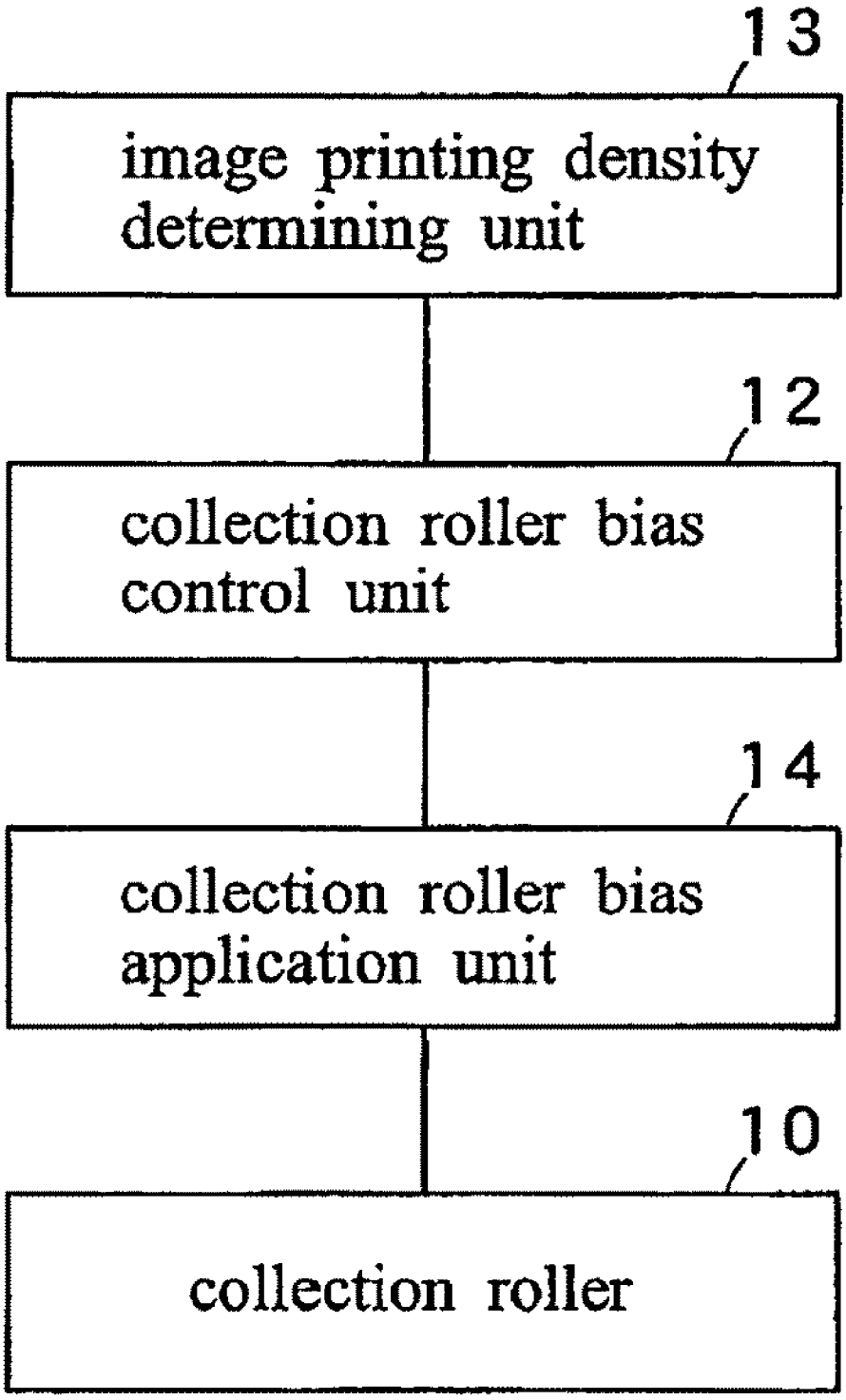
FIG. 3 is a schematic illustration of the unit devices for controlling the bias to be applied to the collection roller.

FIG. 3 is a schematic illustration of the unit devices for controlling the bias to be applied to the collection roller of this embodiment.

As shown in FIG. 3, the image forming apparatus 1 has a collection roller bias control unit 12 that controls the bias to be applied to the collection roller 10. The collection roller bias control unit 12 selects and defines the bias to be applied to the collection roller 10 according to the data accumulated so far on the printing density in the printing operations performed in the past (image forming conditions information) that are supplied from a printing density determining unit 13. Then, the collection roller bias control unit 12 controls collection roller bias application unit 14 for the bias to be applied to the collection roller 10 so as to make the bias agree with the defined bias. The collection roller bias application unit 14 applies the bias selected and defined by the collection roller bias control unit 12 to the collection roller 10.

Figure 4:
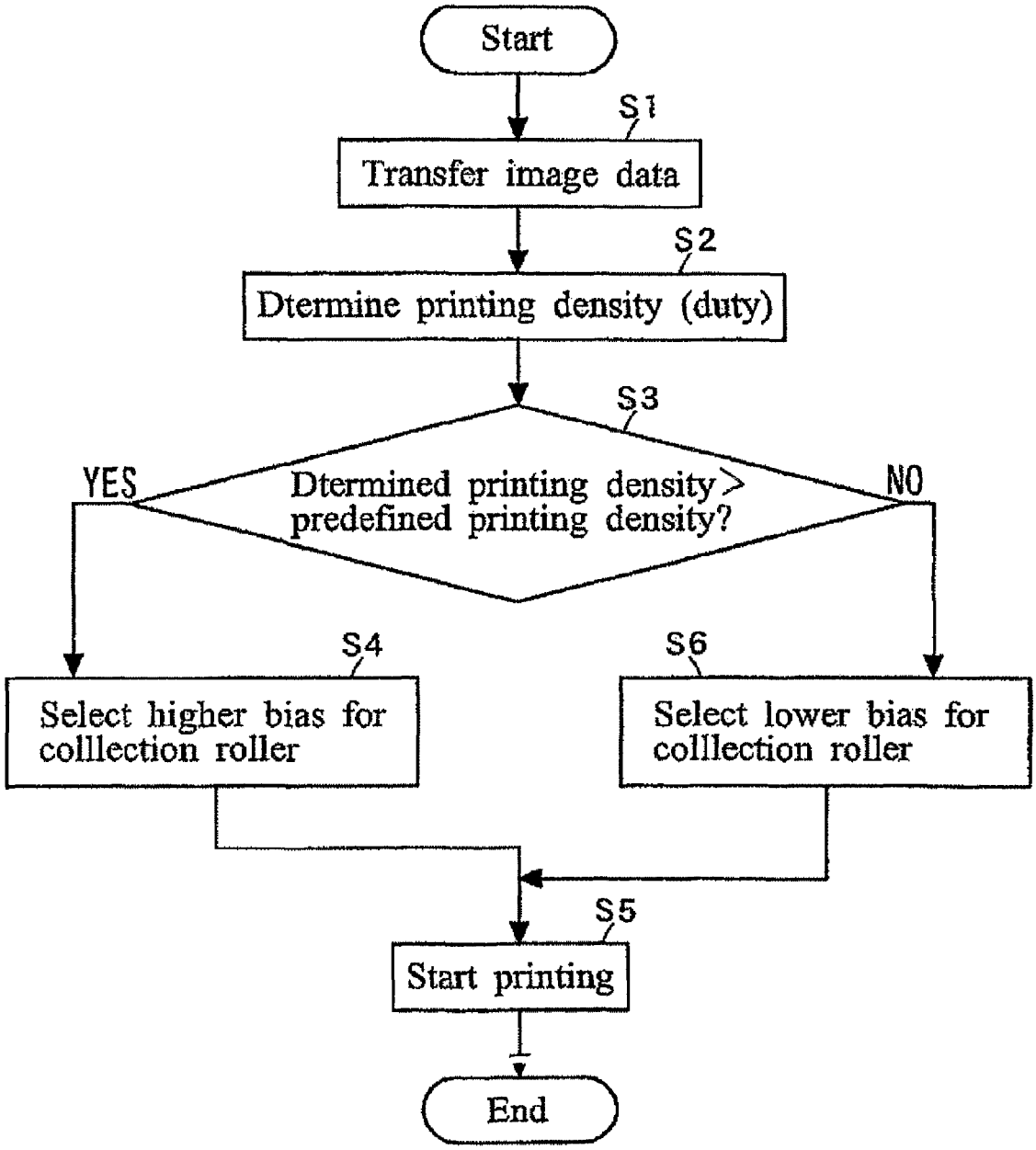
FIG. 4 is a flowchart of the process of controlling the bias to be applied to the collection roller.

FIG. 4 is an exemplar flowchart of the process of controlling the bias to be applied to the collection roller.

An exemplar operation of controlling the bias to be applied to the collection roller 10 so as to make the external additive adhere to the second charging member 9 by a predetermined constant quantity will be described below.

In this exemplar operation of controlling the bias to be applied to the collection roller 10, two biases including a higher bias and a lower bias are selectively employed depending on the printing density (Duty). Referring to FIG. 4, as image data are transferred to the image forming apparatus 1 in Step S1, the printing density (Duty) according to the information accumulated in the printing operations performed in the past is determined in Step S2.

Thereafter, if the printing density (Duty) according to the information accumulated in the printing operations performed in the past is higher than the predefined printing density or not is determined in Step S3. When the printing density (Duty) is determined to be higher than the predefined printing density, the process proceeds to Step S4, where the higher bias is selected for the bias to be applied to the collection roller 10. When it is determined that the printing density (Duty) according to the information accumulated in the printing operations performed in the past is higher than the predefined printing density, it means that the toner content ratio has been rising relative to the external additive in the collected mixture. Therefore, the higher bias is selected for the bias to be applied to the collection roller 10 in order to raise the quantity by which the external additive is collected by the collection roller 10. Then, as a result, the quantity by which the external additive adheres to the brush brittles 9*a* of the second charging member 9 after passing by the collection roller 10 is reduced. Thereafter, the operation of printing an image according to the transferred image data is started in Step S5.

When, on the other hand, the printing density (Duty) is determined to be not higher than the predefined printing density, the process proceeds to Step S6, where the lower bias is selected for the bias to be applied to the collection roller 10. When it is determined that the printing density (Duty) according to the information accumulated in the printing operations performed in the past is not higher than the predefined printing density, it means that the toner content ratio has been falling relative to the external additive in the collected mixture. Therefore, the lower bias is selected for the bias to be applied to the collection roller 10 in order to lower the quantity of the external additive collected by the collection roller 10. Then, as a result, the quantity by which the external additive adheres to the brush brittles 9*a* of the second charging member 9 after passing by the collection roller 10 is raised. Thereafter, the process proceeds to Step S5, where the operation of printing an image according to the transferred image data is started.

The bias to be applied to the collection roller 10 is controlled according to the printing density (Duty) of the image data. Then, as a result, the external additive that provides a charging assisting effect is made to adhere to the second charging member 9 after passing by the collection roller 10 always by a predetermined constant quantity or substantially by a predetermined constant quantity. Note that the technique for controlling the bias to be applied to the collection roller 10 is not limited to the above-described one shown in FIG. 4 and any of various feasible techniques may be selected and employed for the purpose of the present invention.

Thus, image forming unit service life information may typically include photosensitive member service life information and toner cartridge information. Photosensitive member service life information may by turn typically include information on the number of sheets of printing paper used for printing by the photosensitive unit, or the image forming unit. While the photosensitive unit is normally removably fitted to the apparatus main body, it may not necessarily be so. As the number of sheets of printing paper used for printing increases, the cleaning performance and the charging performance of the second charging member 9 may be degraded because, for instance, the brush brittles are worn. Thus, a bias that is higher than the predefined collection roller bias is selected for the collection roller 10 when the number of sheets of printing paper used for printing by the photosensitive unit exceeds a predetermined number of sheets of printing paper. Conversely, a bias that is lower than the predefined collection roller bias is selected for the collection roller 10 when the number of sheets of printing paper used for printing by the photosensitive unit is still short of a predetermined number of sheets of printing paper. With this arrangement of controlling the bias to be applied to the collection roller 10 according to information on the number of sheets of printing paper used for printing by the photosensitive unit, the external additive that provides a charging assisting effect is made to adhere to the second charging member 9 always by a predetermined constant quantity.

Additionally, toner cartridge information may typically include information on the quantity of toner remaining in the toner cartridge. When the quantity of toner remaining in the toner cartridge exceeds a predefined level probably because the toner cartridge is still full, the external additive may be isolated already or readily from toner mother particles to a large extent so that the bias to be applied to the collection roller 10 is set to a level higher than a predefined level of the collection roller bias. Conversely, when the quantity of toner remaining in the toner cartridge is lower than the predetermined level probably because toner is consumed to a large extent, the bias to be applied to the collection roller 10 is set to a level lower than a predefined level of the collection roller bias. Thus, the external additive that provides a charging assisting effect can be made to adhere to the second charging member 9 by a predetermined constant quantity by controlling the bias of the collection roller 10 according to information on the quantity of toner remaining in the cartridge.

On the other hand, image forming conditions information may typically include development bias information defined on the basis of a patching operation and printing density information. The development bias is determined according to a patching operation in an image forming apparatus 1 and development bias information is information on the determined development bias. More specifically, a bias higher than the predefined collection roller bias is selected for the collection roller 10 when a development bias higher than a predefined development bias is selected because then the external additive can move to the photosensitive member 2 with ease. Conversely, a bias lower than the predefined collection roller bias is selected for the collection roller 10 when a development bias lower than a predefined development bias is selected because then the external additive moves to the photosensitive member 2 with difficulty. With this arrangement of controlling the bias to be applied to the collection roller 10 according to information on the development bias, the external additive that provides a charging assisting effect is made to adhere to the second charging member 9 always by a predetermined constant quantity.

Additionally, the collection roller cleaning blade 11 is designed to clean the collection roller 10 after the residual toner left on the collection roller 10 is collected and removed.

The exposure unit 4 writes an electrostatic latent image on the photosensitive member 2 by irradiating the photosensitive member 2 with light, which may typically be a laser beam.

The development unit 5 employs toner prepared by adding an external additive that provides a charging assisting effect to toner mother particles. Any of the known toner substances such as polyester or styrene acryl can be used for toner mother particles. Any of the known charging control agents such as silica or titania can be used for the external additive that provides a charging assisting effect. The toner laid on the development roller whose thickness is controlled to show a predetermined thickness is then conveyed toward the photosensitive member 2 by means of the development roller and the electrostatic latent image on the photosensitive member 2 is developed by the conveyed toner to produce a toner image on the photosensitive member 2.

The transfer unit 7 transfers the toner image on the photosensitive member 2 onto a transfer medium 6 which may be a sheet of transfer paper or an intermediate transfer medium typically by means of a transfer roller. When a toner image is transferred onto a sheet of transfer paper, the image forming apparatus 1 fixes the toner image on the sheet of transfer paper by means of a fixation unit (not shown) to produce a fixed image on the sheet of transfer paper. When, on the other hand, a toner image is transferred onto an intermediate transfer medium, the image forming apparatus 1 transfers the toner image on the intermediate transfer medium further onto a sheet of transfer paper by means of a transfer unit and then fixes the toner image on the sheet of transfer paper by means of a fixation unit (not shown) to produce a fixed image on the sheet of transfer paper.

Thus, with the image forming apparatus 1 of the first embodiment having a configuration as described above, residual toner is left on the photosensitive member 2 after a transfer operation of transferring the toner image on the photosensitive member 2 onto a transfer medium 6 by means of the transfer unit 7. The residual toner is then electrically charged as the brush roller of the first charging member 8 is driven to rotate because a voltage having a polarity same as that of the charged potential of the toner is applied to the first charging members. The residual toner on the photosensitive member 2 that is electrically charged by the first charging member 8 is then seized and collected as the brush roller of the second charging member 9 is driven to rotate because a voltage having a polarity opposite to that of the charged potential of the toner is applied to the second charging member 9. Then, as a result, the toner mother particles and the external additive in the residual toner adhering to the brush brittles 9*a* of the second charging member 9 are partly collected as the collection roller 10 is driven to rotate because a controlled bias is applied to the collection roller 10 while a given constant quantity of the external additive remains adhering to the brush brittles 9*a* of the second charging member 9. In this way, the external additive, which provides a charging assisting effect, is made to adhere to the brush brittles 9*a* of the second charging member 9 always by a predetermined constant quantity.

Thus, the photosensitive member 2 is electrically charged by the second charging member 9 to which the external additive is made to adhere always by a predetermined constant quantity. Then, the photosensitive member 2 is electrically uniformly charged because the external additive that is made to adhere to the brush brittles 9*a* always by a predetermined constant quantity provides a charging assisting effect. As a result, the image forming apparatus 1 of the first embodiment can ensure an excellent image quality stably over a long period of time without using a cleaning blade for the photosensitive member 2.

The toner mother particles and the external additive adhering onto the collection roller 10 and are then collected and removed by the collection roller cleaning blade 11. As a result, the collection roller 10 can effectively collect part of the toner mother particles and the external additive adhering to the collection roller 10 over a long period of time.

Now, an image forming apparatus according to the present invention will be described further by way of four examples and ten comparative examples where experiments were conducted. Laser Printer LP-9000C available from Seiko Epson Corporation was used as image forming apparatus for the experiments. The charging section of the photosensitive member unit of the LP-9000C was modified in such a way that two charging brushes could be fitted to it respectively as a first charging member 8 and a second charging member 9 and also a collection roller, which was a metal roller, could be fitted thereto. The photosensitive member cleaning blade of the photosensitive member unit of LP-9000C was removed.

Brush (1) shown in Table 1 below was used for the first charging member 8, while two brushes, or brush (1) and brush (2) shown in Table 1, were used for the second charging member 9 (to be referred to as the second charging member (1) and the second charging member (2) respectively hereinafter). The brushes, or the brush (1) and the brush (2), were available from Toeisangyo Co., Ltd.

TABLE 1

| | Brush (1) | Brush (2) |
|---|---|---|
| Material | 6 nylon | 6 nylon |
| Fiber fineness | 220T/96F | 330T/48F |
| Density | 120 kf/inch$^2$ | 80 kf/inch$^2$ |
| Electric resistance of thread for weaving | 7.1 LogΩ | 9.3 LogΩ |
| Pile length | 5 mm | 5 mm |
| Dimensions | 300 × 5 × 5 | 300 × 5 × 5 |

As shown in Table 1, the brush (1) was made of 6 nylon and the fiber fineness was 220T/96F, while the density and the electric resistance of a thread for weaving were respectively 120 kf/inch$^2$ and 7.1 Log Ω and the pile length and the dimensions were respectively 5 mm and length: 300 mm, width: 5 mm and height: 5 mm. The brush (2) was also made of 6 nylon and the fiber fineness was 330T/48F, while the density and the electric resistance of a thread for weaving were respectively 80 kf/inch$^2$ and 9.3 Log Ω and the pile length and the dimensions were respectively 5 mm and length: 300 mm, width: 5 mm and height: 5 mm.

A voltage of −1,200 V was applied to the first charging member 8, while a voltage of +200 V was applied to the second charging member 9.

Two types of mother particles, or mother particles (1) and mother particles (2), shown in Table 2 below were used for the toner mother particles of the toner used in the experiments.

TABLE 2

| | Material | Method of preparation |
|---|---|---|
| Mother particle (1) | polyester | polymerization |
| Mother particle (2) | styrene acryl | crushing |

As shown in Table 2, the mother particle (1) is made of polyester and prepared by polymerization. Since a known process was used in the experiments for preparing toner mother particles by polymerization and does not constitute any characteristic part of the present invention, it will not be described here in greater detail. The mother particle (2) is made of styrene acryl and prepared by crushing. Again, since a known process was used in the experiments for preparing toner mother particles by crushing and does not constitute any characteristic part of the present invention, it will not be described here in greater detail.

Three types of external additives for toner, or external additives (1) through (3), shown in Table 3 below were used.

TABLE 3

| | Material 1 | Material 2 |
|---|---|---|
| External additive (1) | silica (RX200): 1 wt % | |
| External additive (2) | silica (RY50): 1 wt % | |
| External additive (3) | silica (RX200): 0.5 wt % | titania (T805): 0.5 wt % |

* The listed values are weight % relative to toner

* Reference document for external additives: Journal of the Imaging Society of Japan Vol. 43 No. 5, 2004, Nippon Aerosil Co., Ltd.

As shown in Table 3, the external additive (1) was prepared by using only silica (RX200) and added to toner mother particles by 1 wt %. The external additive (2) was prepared by using only silica (RY50) and added to toner mother particles by 1 wt %. Finally, the external additive (3) was prepared by using two materials of silica (RX200) and titania (T805), which silica (RX200) and titania (T805) were added to toner mother particles respectively by 0.5 wt % and 0.5 wt %.

The structure of the image forming apparatus 1 used for the experiments was otherwise the same as Laser Printer LP-9000C and the experiments were conducted according to the image forming control process of Laser Printer LP-9000C, while controlling the bias that was applied to the collection roller 10. In each of the experiments, a 10% density printing pattern was printed on 100 sheets and subsequently a half tone image was printed on them. Then, the uneven density, if any, was visually checked on the half tone images and judged as unevenly charged. Thereafter, a white solid image was printed also on 100 sheets and subsequently a half tone image was printed on them. Then, the image quality was judged for them in a manner as described above. Each example where the image quality was determined good by both of the judgments was rated as excellent (o) and each example where the image quality was determined good only by one of the judgments was rated as good (Δ), whereas each example where the image quantity was determined not good by both of the judgments was rated as no good (x).

The combination of the brush of the second charging member 9, the toner mother particles and the external additive and the voltage (bias) applied to the collection roller that were used in each of Examples and Comparative Examples are shown in Table 4 below. The ratings given to Examples and Comparative Examples are also listed in Table 4.

solid image was +400 V in Example 2. The image quality of both of the images was judged as good and hence rated as excellent (o).

Brush (1) was used for the second charging member 9 and toner mother particles (1) and external additive (3) were selected for use, while the voltage applied to the collection roller for printing an all 10% density printing pattern was +420 V and the voltage applied to the collection roller for printing a white solid image was +300 V in Example 3. The image quality of both of the images was judged as good and hence rated as excellent (o). Brush (2) was used for the second charging member 9 and toner mother particles (2) and external additive (3) were selected for use, while the voltage applied to the collection roller for printing an all 10% density printing pattern was +500 V and the voltage applied to the collection roller for printing a white solid image was +450 V in Example 4. The image quality of both of the images was judged as good and hence rated as excellent (o).

In Comparative Example 1, brush (1) was used for the second charging member 9 and toner mother particles (1) and external additive (1) were selected for use, while the voltage applied to the collection roller for printing an all 10% density printing pattern was +500 V and the voltage applied to the collection roller for printing a white solid image was +500 V. The image quality of both of the images was judged as not good and hence rated as no good (x) In Comparative Example 2, brush (1) was used for the second charging member 9 and toner mother particles (1) and external additive (1) were selected for use, while the voltage applied to the collection roller for printing an all 10% density printing pattern was +400 V and the voltage applied to the collection roller for printing a white solid image was +400 V. The image quality of only one of the images was judged as good and hence rated as good (Δ).

TABLE 4

| | 2nd charging member (No.) | Toner mother particles (No.) | External additive (No.) | Voltage applied to collection roller for 10% density printing | Voltage applied to collection roller for white solid image printing | Half tone image rating |
|---|---|---|---|---|---|---|
| Example 1 | (1) | (1) | (1) | +400 | +400 | ○ |
| Example 2 | (1) | (1) | (2) | +500 | +400 | ○ |
| Example 3 | (1) | (1) | (3) | +420 | +300 | ○ |
| Example 4 | (2) | (2) | (3) | +500 | +450 | ○ |
| Comp. Ex. 1 | (1) | (1) | (1) | +500 | ← | x |
| Comp. Ex. 2 | (1) | (1) | (1) | +400 | ← | Δ |
| Comp. Ex. 3 | (1) | (1) | (1) | +300 | ← | x |
| Comp. Ex. 4 | (1) | (1) | (2) | +500 | ← | Δ |
| Comp. Ex. 5 | (1) | (1) | (3) | +400 | ← | Δ |
| Comp. Ex. 6 | (1) | (2) | (3) | +500 | ← | Δ |
| Comp. Ex. 7 | (2) | (1) | (2) | +550 | ← | Δ |
| Comp. Ex. 8 | (2) | (2) | (3) | +500 | ← | Δ |
| Comp. Ex. 9 | (1) | (1) | (1) | +400 | +500 | x |
| Comp. Ex. 10 | (1) | (1) | (2) | +500 | +550 | x |

As shown in Table 4, brush (1) was used for the second charging member 9 and toner mother particles (1) and external additive (1) were selected for use, while the voltage applied to the collection roller for printing an all 10% density printing pattern was +400 V and the voltage applied to the collection roller for printing a white solid image was +400 V in Example 1. The image quality of both of the images was judged as good and hence rated as excellent (o). Brush (1) was used for the second charging member 9 and toner mother particles (1) and external additive (2) were selected for use, while the voltage applied to the collection roller for printing an all 10% density printing pattern was +500 V and the voltage applied to the collection roller for printing a white In Comparative Example 3, brush (1) was used for the second charging member 9 and toner mother particles (1) and external additive (1) were selected for use, while the voltage applied to the collection roller for printing an all 10% density printing pattern was +300 V and the voltage applied to the collection roller for printing a white solid image was +300 V. The image quality of both of the images was judged as not good and hence rated as no good (x). In Comparative Example 4, brush (1) was used for the second charging member 9 and toner mother particles (1) and external additive (2) were selected for use, while the voltage applied to the collection roller for printing an all 10% density printing pattern was +500 V and the voltage applied to the collection roller for printing a white solid image was +500 V. The image quality of only one of the images was judged as good and hence rated as good (Δ).

In Comparative Example 5, brush (1) was used for the second charging member 9 and toner mother particles (1) and external additive (3) were selected for use, while the voltage applied to the collection roller for printing an all 10% density printing pattern was +400 V and the voltage applied to the collection roller for printing a white solid image was +400 V. The image quality of only one of the images was judged as good and hence rated as good (Δ). In Comparative Example 6, brush (1) was used for the second charging member 9 and toner mother particles (2) and external additive (3) were selected for use, while the voltage applied to the collection roller for printing an all 10% density printing pattern was +500 V and the voltage applied to the collection roller for printing a white solid image was +500 V. The image quality of only one of the images was judged as good and hence rated as good (Δ).

In Comparative Example 7, brush (2) was used for the second charging member 9 and toner mother particles (1) and external additive (2) were selected for use, while the voltage applied to the collection roller for printing an all 10% density printing pattern was +550 V and the voltage applied to the collection roller for printing a white solid image was +550 V. The image quality of only one of the images was judged as good and hence rated as good (Δ). In Comparative Example 8, brush (2) was used for the second charging member 9 and toner mother particles (2) and external additive (3) were selected for use, while the voltage applied to the collection roller for printing an all 10% density printing pattern was +500 V and the voltage applied to the collection roller for printing a white solid image was +500 V. The image quality of only one of the images was judged as good and hence rated as good (Δ).

In Comparative Example 9, brush (1) was used for the second charging member 9 and toner mother particles (1) and external additive (1) were selected for use, while the voltage applied to the collection roller for printing an all 10% density printing pattern was +400 V and the voltage applied to the collection roller for printing a white solid image was +500 V. The image quality of both of the images was judged as not good and hence rated as no good (x). In Comparative Example 10, brush (1) was used for the second charging member 9 and toner mother particles (1) and external additive (2) were selected for use, while the voltage applied to the collection roller for printing an all 10% density printing pattern was +500 V and the voltage applied to the collection roller for printing a white solid image was +550 V. The image quality of both of the images was judged as not good and hence rated as no good (x).

From the above-described results of the experiments, it was confirmed that no good image quality can be achieved when the bias applied to the collection roller 10 for printing a white solid image is made higher than the bias applied to the collection roller 10 for printing an all 10% density printing pattern. Therefore, a good image quality can be obtained when a higher bias is applied to the collection roller 10 for printing an all 10% density printing pattern because the printing density is high when printing the pattern. On the other hand, a good image quality can be obtained when a lower bias is applied to the collection roller 10 for printing a white solid image because the printing density is low when printing the image. Thus, it was proved that the method of electrically charging an image carrier that is employed for a charging device 3 and an image forming apparatus 1 according to the present invention can achieve the intended effect.

Now, the second embodiment of image forming apparatus according to the present invention will be described below. While an external additive that provides a charging assisting effect is employed for the image forming apparatus 1 of the first embodiment, an external additive that provides a charging assisting effect and an external additive that provides a polishing effect are employed for the image forming apparatus 1 of the second embodiment.

Figure 5C:
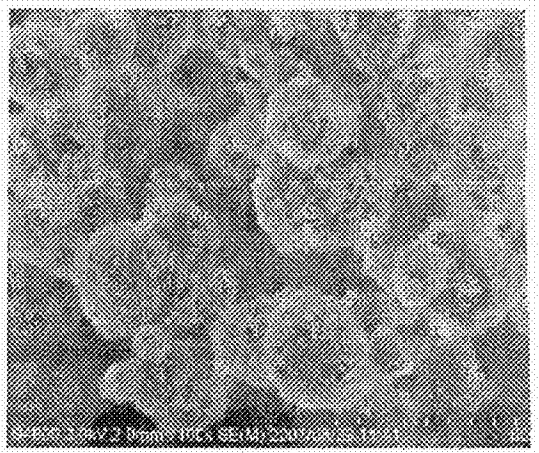
FIG. 5C is an enlarged schematic microscopic view of particles of an external additive that can be used for the second embodiment of the present invention to provide a polishing effect, showing still another characteristic profile of individual particles.
Figure 5B:
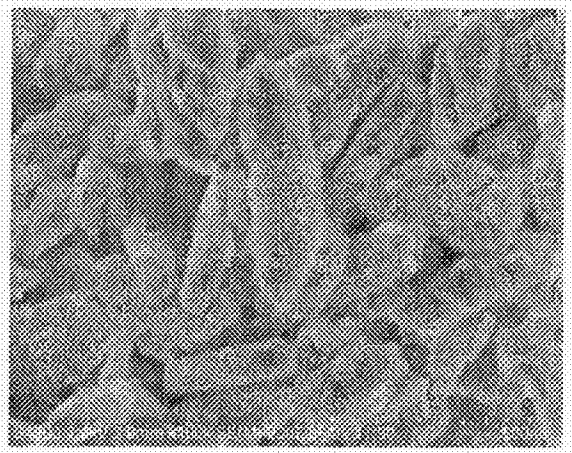
FIG. 5B is an enlarged schematic microscopic view of particles of an external additive that can be used for the second embodiment of the present invention to provide a polishing effect, showing another characteristic profile of individual particles.
Figure 5A:
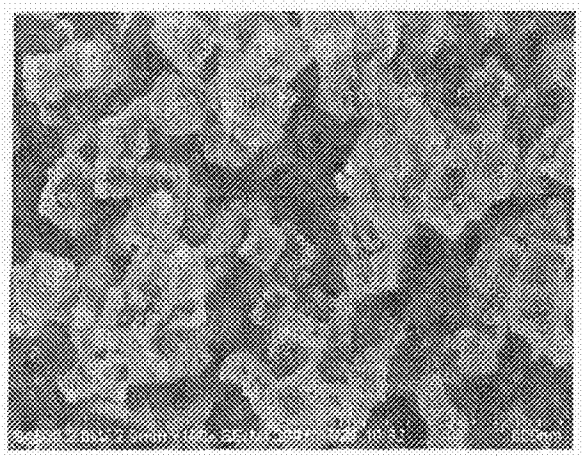
FIG. 5A is an enlarged schematic microscopic view of particles of an external additive that can be used for a second embodiment of the present invention to provide a polishing effect, showing a characteristic profile of individual particles.

More specifically, toner prepared by adding an external additive that provides a charging assisting effect and an external additive that provides a polishing effect are added to toner mother particles in the development unit 5 of the image forming apparatus 1 of the second embodiment. Here again, any of the known toner substances such as polyester or styrene acryl can be used for toner mother particles. Any of the known charging control agents such as silica or titania can be used for the external additive that provides a charging assisting effect. Additionally, any of the known external additives that provide a polishing effect such as cerium oxide, strontium titanate or alumina can be selected for use for the purpose of the image forming apparatus of the second embodiment. The particles of the external additive that provides a polishing effect may be made to show an angular cubic profile as shown in FIG. 5A, a needle-like profile as shown in FIG. 5B or a profile showing a low degree of circularity (preferably not higher than 90) as shown in FIG. 5C, although the particles of the external additive that provides a polishing effect may be made to show some other profiles so long as it is good for polishing.

The bias to be applied to the collection roller of the image forming apparatus 1 of the second embodiment is controlled typically by means of the process illustrated in the flowchart of FIG. 4.

Therefore, the bias to be applied to the collection roller 10 is controlled according to the printing density (duty) of the image data to be used by the image forming apparatus 1 for a printing operation. Then, as a result, the external additive that provides a polishing effect is made to adhere to the second charging member 9 after passing by the collection roller 10 always by a predetermined constant quantity or substantially by a predetermined constant quantity. Note that the technique for controlling the bias to be applied to the collection roller 10 is not limited to the above-described one shown in FIG. 4 and any of various feasible techniques may be selected and employed for the purpose of the present invention.

Thus, as in the case of the image forming apparatus 1 of the first embodiment, image forming unit service life information may typically include photosensitive member service life information and toner cartridge information. Photosensitive member service life information may by turn typically include information on the number of sheets of printing paper used for printing by the photosensitive unit, or the image forming unit. Thus, as in the case of the first embodiment, the external additive that provides a polishing effect is made to adhere to the second charging member 9 always by a predetermined constant quantity by controlling the bias to be applied to the collection roller 10 according to information on the number of sheets of printing paper used for printing by the photosensitive unit.

Additionally, toner cartridge information may typically include information on the quantity of toner remaining in the toner cartridge. Thus, as in the case of the first embodiment, the external additive that provides a polishing effect can be made to adhere to the second charging member 9 by a predetermined constant quantity by controlling the bias of the collection roller 10 according to information on the quantity of toner remaining in the cartridge.

On the other hand, image forming conditions information may typically include development bias information defined on the basis of a patching operation and printing density information. The development bias is determined according to a patching operation in an image forming apparatus 1 and development bias information is information on the determined development bias. Thus, as in the case of the first embodiment, the external additive that provides a polishing effect can be made to adhere to the second charging member 9 by a predetermined constant quantity by controlling the bias of the collection roller 10 according to development bias that is obtained according to a patching operation.

Otherwise, the configuration of the image forming apparatus 1 of the second embodiment is the same as that of the image forming apparatus 1 of the first embodiment.

Thus, with the image forming apparatus 1 of the second embodiment having a configuration as described above, residual toner is left on the photosensitive member 2 after a transfer operation of transferring the toner image on the photosensitive member 2 onto a transfer medium 6 by means of the transfer unit 7. Additionally, the discharge products that are produced in the charging operation also adhere onto the photosensitive member 2 after the transfer operation. The residual toner left after the transfer operation and foreign objects including discharge products are then electrically charged by the first charging member 8 to which a voltage showing a polarity same as that of the charged potential of the foreign objects (including the residual toner) is applied as the brush roller of the first charging member 8 is driven to rotate. The foreign objects on the photosensitive member 2 that are electrically charged by the first charging member 8 are then seized and collected by the rotation of the brush roller of the second charging member 9 to which a voltage showing a polarity opposite to that of the charged potential of the residual toner is applied. As a result, of the foreign objects adhering to the brush brittles 9*a* of the second charging member 9, part of the toner mother particles, part of the external additive and the foreign objects including the discharge products are collected by a collection roller 10 bearing a controlled bias applied thereto as the latter is driven to rotate while the external additive adheres to the brush brittles 9*a* of the second charging member 9 by a predetermined constant quantity. In this way, both the external additive that provides a charging assisting effect and the external additive that provides a polishing effect are made to adhere to the brush brittles 9*a* of the second charging member 9 by respective predetermined constant quantities.

Thus, the photosensitive member 2 is electrically charged by the second charging member 9 having the brush brittles 9*a* to which the external additive is made to adhere always by a predetermined constant quantity. Of the external additive that is made to adhere to the brush brittles 9*a* by a predetermined constant quantity, the external additive that provides a charging assisting effect operates as a charging assisting agent, the photosensitive member 2 is electrically uniformly charged. Of the external additive that is made to adhere to the brush brittles 9*a* by a predetermined constant quantity, the external additive that provides a polishing effect operates as a polishing agent for scraping off the foreign objects such as the discharge products that are made to adhere to the photosensitive member 2 by the electric discharge in a charging operation, foreign objects can be effectively prevented from being deposited on the photosensitive member 2. As a result, the image forming apparatus 1 of the second embodiment can ensure an excellent image quality stably over a long period of time.

The external additive to be used for an image forming apparatus 1 according to the present invention is not necessarily required to provide a charging assisting effect as described above for the second embodiment of image forming apparatus 1. In other words, it is only required to provide a polishing effect. If toner to be used for an image forming apparatus according to the present invention is required to provide an excellent charging effect, an external additive that provides a charging assisting effect can be used whenever necessary.

Now, the image forming apparatus of the second embodiment will be described further by way of four examples and nine comparative examples where experiments were conducted. The image forming apparatus used in the experiments is the same as the one used in the experiments conducted for the first embodiment. Brush (1) shown in Table 1 below was used for the first charging member 8, while two brushes, or brush (1) and brush (2) shown in Table 1, were used for the second charging member 9. As in the case of the first embodiment, a voltage of −1,200 V was applied to the first charging member 8, while a voltage of +200 V was applied to the second charging member 9.

Two types of mother particles, or mother particles (1) and mother particles (2), shown in Table 2 above were used for the toner mother particles of the toner used in the experiments as in the case of the first embodiment. Three types of external additives for toner, or external additives (1) through (3), shown in Table 5 below were used.

TABLE 5

| | External additive (1) | External additive (2) | External additive (3) |
|---|---|---|---|
| Material 1 | silica (RX200): 1 wt % | silica (RY50): 1 wt % | silica (RX200): 0.5 wt % |
| Material 2 | | | titania (T805): 0.5 wt % |
| Material 3 | cerium oxide: 1 wt % | strontium titanate: 1 wt % | alumina: 1 wt % |
| Degree of charging | 40 μC/g | 60 μC/g | 15 μC/g |

* The listed values are weight % relative to toner

* Reference document for external additives: Journal of the Imaging Society of Japan Vol. 43 No. 5, 2004, Nippon Aerosil Co., Ltd.

As shown in Table 5, the external additive (1) was prepared by using two materials including silica (RX200) and cerium oxide, of which silica (RX200) was added to toner mother particles by 1 wt % and cerium oxide was also added to toner mother particles by 1 wt %. The degree to which the cerium oxide was charged was 40 μC/g, which was relatively high. The external additive (2) was prepared by using two materials including silica (RY50) and strontium titanate, of which silica (RX50) was added to toner mother particles by 1 wt % and strontium titanate was also added to toner mother particles by 1 wt %. The rate to which the strontium titanate was charged was 60 μC/g, which was also relatively high. Finally, the external additive (3) was prepared by using three materials including silica (RX200), titania (T805) and alumina, of which silica (RX200) was added to toner mother particles by 0.5 wt % and titania (T805) was added to toner mother particles also by 0.5 wt %, while alumina was added to toner parent potentials by 1 wt %. The degree to which the alumina was charged was 15 μC/g, which was relatively low.

The experiments were conducted according to the image forming control process of Laser Printer LP-9000C, while controlling the bias that was applied to the collection roller 10. In each of the experiments, an all 5% density printing pattern was printed on 100 sheets and subsequently a white solid image was printed on 100 sheets. The two printing sessions were alternately conducted continuously until 1,000 sheets were consumed for the printing. Thereafter, a half tone image was printed on them and the printed half tone images were visually checked to determine the condition of the photosensitive member 2. Each example where the image quality of the half tone images was determined good was rated as excellent (o), whereas each example where the image quantity of the half tone images was determined not good was rated as no good (x).

The combination of the brush of the second charging member 9, the toner mother particles and the external additive and the voltage (bias) applied to the collection roller that were used in each of Examples and Comparative Examples are shown in Table 6 below. The ratings given to Examples and Comparative Examples are also listed in Table 6.

TABLE 6

| | 2nd charging member (No.) | Toner mother particles (No.) | External additive (No.) | Voltage applied to collection roller for 5% density printing | Voltage applied to collection roller for white solid image printing | Half tone image rating |
|---|---|---|---|---|---|---|
| Example 5 | (1) | (1) | (1) | +500 | +400 | ○ |
| Example 6 | (1) | (1) | (2) | +400 | +300 | ○ |
| Example 7 | (2) | (1) | (1) | +550 | +500 | ○ |
| Example 8 | (2) | (2) | (2) | +500 | +450 | ○ |
| Comp. Ex. 11 | (1) | (1) | (1) | +500 | ← | x (uneven image) |
| Comp. Ex. 12 | (1) | (1) | (1) | +400 | ← | x (uneven image) |
| Comp. Ex. 13 | (1) | (1) | (1) | +300 | ← | x (fogged image) |
| Comp. Ex. 14 | (1) | (1) | (3) | +600 | +500 | x (striped image) |
| Comp. Ex. 15 | (1) | (1) | — | +500 | +400 | x (striped image) |
| Comp. Ex. 16 | (1) | (2) | (2) | +500 | ← | x (uneven image) |
| Comp. Ex. 17 | (2) | (1) | (2) | +550 | ← | x (uneven image) |
| Comp. Ex. 18 | (1) | (1) | (1) | +500 | +600 | x (uneven image) |
| Comp. Ex. 19 | (1) | (1) | (2) | +400 | +450 | x (uneven image) |

As shown in Table 6, brush (1) was used for the second charging member 9 and toner mother particles (1) and external additive (1) were selected for use, while the voltage applied to the collection roller for printing an all 5% density printing pattern was +500 V and the voltage applied to the collection roller for printing a white solid image was +400 V in Example 5. The image quality of the half tone images was judged as good and hence rated as excellent (o). Brush (1) was used for the second charging member 9 and toner mother particles (1) and external additive (2) were selected for use, while the voltage applied to the collection roller for printing an all 5% density printing pattern was +400 V and the voltage applied to the collection roller for printing a white solid image was +300 V in Example 6. The image quality of the half tone images was judged as good and hence rated as excellent (o).

Brush (2) was used for the second charging member 9 and toner mother particles (1) and external additive (1) were selected for use, while the voltage applied to the collection roller for printing an all 5% density printing pattern was +550 V and the voltage applied to the collection roller for printing a white solid image was +500 V in Example 7. The image quality of the half tone images was judged as good and hence rated as excellent (o). Brush (2) was used for the second charging member 9 and toner mother particles (2) and external additive (2) were selected for use, while the voltage applied to the collection roller for printing an all 5% density printing pattern was +500V and the voltage applied to the collection roller for printing a white solid image was +400 V in Example 8. The image quality of the half tone images was judged as good and hence rated as excellent (o).

In Comparative Example 11, brush (1) was used for the second charging member 9 and toner mother particles (1) and external additive (1) were selected for use, while the voltage applied to the collection roller for printing an all 5% density printing pattern was +500 V and the voltage applied to the collection roller for printing a white solid image was +500 V. The image quality of the half tone images was judged as not good and hence rated as no good (x) because the images were uneven density images. In Comparative Example 12, brush (1) was used for the second charging member 9 and toner mother particles (1) and external additive (1) were selected for use, while the voltage applied to the collection roller for printing an all 5% density printing pattern was +400 V and the voltage applied to the collection roller for printing a white solid image was +400 V. The image quality of the half tone images was judged as not good and hence rated as no good (x) because the images were uneven density images.

In Comparative Example 13, brush (1) was used for the second charging member 9 and toner mother particles (1) and external additive (1) were selected for use, while the voltage applied to the collection roller for printing an all 5% density printing pattern was +300 V and the voltage applied to the collection roller for printing a white solid image was +300 V. The image quality of the half tone images was judged as not good and hence rated as no good (x) because the images were fogged images. In Comparative Example 14, brush (1) was used for the second charging member 9 and toner mother particles (1) and external additive (3) were selected for use, while the voltage applied to the collection roller for printing an all 5% density printing pattern was +600 V and the voltage applied to the collection roller for printing a white solid image was +500 V. The image quality of the half tone images was judged as not good and hence rated as no good (x) because the images were striped images.

In Comparative Example 15, brush (1) was used for the second charging member 9 and toner mother particles (1) was selected for use but no external additive was used, while the voltage applied to the collection roller for printing an all 5% density printing pattern was +500 V and the voltage applied to the collection roller for printing a white solid image was +400 V. The image quality of the half tone images was judged as not good and hence rated as no good (x) because the images were striped images. In Comparative Example 16, brush (1) was used for the second charging member 9 and toner mother particles (2) and external additive (2) were selected for use, while the voltage applied to the collection roller for printing an all 5% density printing pattern was +500 V and the voltage applied to the collection roller for printing a white solid image was +500 V. The image quality of the half tone images was judged as not good and hence rated as no good (x) because the images were uneven density images.

In Comparative Example 17, brush (2) was used for the second charging member 9 and toner mother particles (1) and external additive (2) were selected for use, while the voltage applied to the collection roller for printing an all 5% density printing pattern was +550 V and the voltage applied to the collection roller for printing a white solid image was +550 V. The image quality of the half tone images was judged as not good and hence rated as no good (x) because the images were uneven density images.

In Comparative Example 18, brush (1) was used for the second charging member 9 and toner mother particles (1) and external additive (1) were selected for use, while the voltage applied to the collection roller for printing an all 5% density printing pattern was +500 V and the voltage applied to the collection roller for printing a white solid image was +600 V. The image quality of the half tone images was judged as not good and hence rated as no good (x) because the images were uneven density images. In Comparative Example 19, brush (1) was used for the second charging member 9 and toner mother particles (1) and external additive (2) were selected for use, while the voltage applied to the collection roller for printing an all 5% density printing pattern was +400 V and the voltage applied to the collection roller for printing a white solid image was +450 V. The image quality of the half tone images was judged as not good and hence rated as no good (x) because the images were uneven density images.

From the above-described results of the experiments, it was found that a good image quality can be achieved by applying a higher bias to the collection roller 10 when printing an all 5% density printing pattern because the printing density is relatively high, whereas a good image quality can be achieved by applying a lower bias to the collection roller 10 when printing a white solid image because the printing density is low.

It was also found that a good image quality cannot necessarily be achieved by applying a bias to the collection roller 10 for printing a white solid image lower than the bias to be applied to the collection roller 10 for printing an all 5% density printing pattern as in Comparative Example 14. This is probably because the rate to which the alumina added as an external additive that provides a polishing effect was 15 μC/g, which is relatively low, and hence the alumina was not effectively electrically charged. Thus, it was found that the bias to be applied to the collection roller 10 can be effectively controlled by using an external additive such as cerium oxide or strontium titanate that provides a polishing effect and can be electrically charged to a relatively high degree, whereas the bias to be applied to the collection roller 10 cannot be effectively controlled by using an external additive such as alumina that provides a polishing effect but can be electrically charged only to a relatively low degree.

Furthermore, it was found that a good image quality cannot necessarily be achieved by selecting a bias to be applied to the collection roller 10 for printing a white solid image lower than the bias to be applied to the collection roller 10 for printing an all 5% density printing pattern even when neither an external additive that provides a polishing effect nor an external additive that provides a charging assisting effect is added as in the case of Comparative Example 15.

Additionally, it was found that a good image quality cannot be achieved by selecting a bias to be applied to the collection roller 10 for printing a white solid image higher than the bias to be applied to the collection roller 10 for printing an all 5% density printing pattern as in the case of Comparative Examples 18 and 19.

As described above, it has been confirmed that a charging device 3, an image forming apparatus 1 and a method of charging an image carrier according to the present invention provides the intended effects and advantages.

Figure 6:
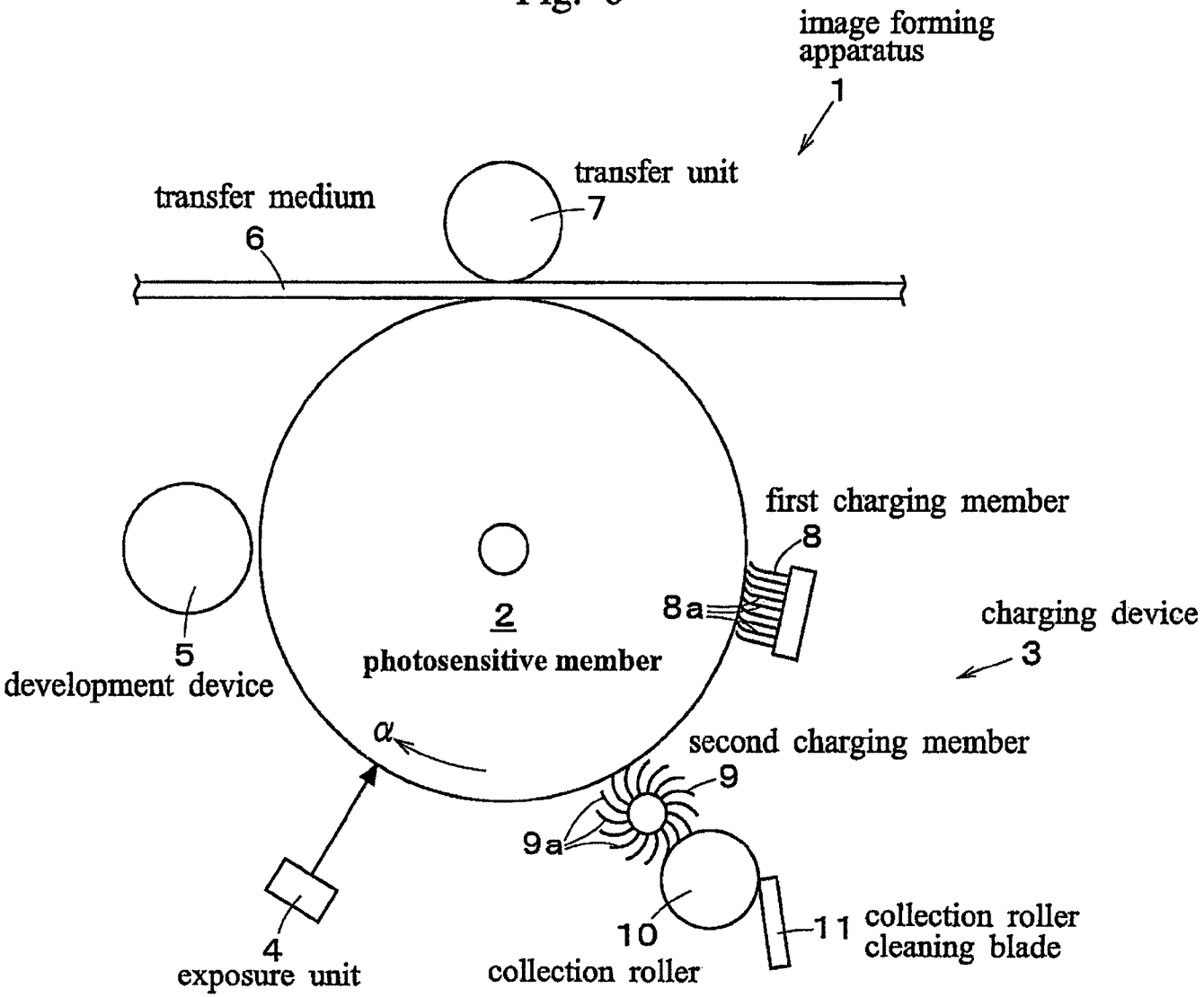
FIG. 6 is a schematic partial view of image forming apparatus according to a third embodiment of the present invention.

FIG. 6 is a schematic partial view of the third embodiment of image forming apparatus according to the present invention.

While a rotatable brush roller is used for the first charging member 8 of the charging device 3 of the image forming apparatus 1 illustrated in FIG. 1, a stationary brush is employed for the first charging member 8 of the charging device 3 of the image forming apparatus of the third embodiment as shown in FIG. 6.

Otherwise, the configuration of the image forming apparatus 1 of the third embodiment is the same as that of the first embodiment and that of the second embodiment. The effects and advantages of the image forming apparatus 1 of the third embodiment are also the same as those of the first embodiment and those of the second embodiment.

The present invention is by no means limited to the above-described embodiments, which may be modified and altered without departing from the scope of the present invention as defined in the appended claims.

What is claimed is:

1. A charging device comprising at least:

a first charging member held in contact with an image carrier, a toner image of toner containing toner mother particles and an external additive added thereto being to be formed thereon, a bias showing a polarity same as that of the charged potential of toner being to be applied thereto;

a second charging member arranged downstream relative to the first charging member as viewed in the moving direction of the image carrier and held in contact with the image carrier, a bias showing a polarity opposite to the charged potential of toner being to be applied thereto;

a collection member held in contact with the second charging member to collect the toner adhering to the second charging member, a bias being to be applied thereto; and a collection member bias control unit for controlling the bias to be applied to the collection member according to image forming conditions information.

2. The device according to claim 1, wherein charging brush members are employed respectively for the first charging member and the second charging member.

3. The device according to claim 2, wherein at least the charging brush member of the second charging member is a brush roller.

4. The device according to claim 1, wherein the image forming conditions information is development bias information.

5. The device according to claim 1, wherein the image forming conditions information is printing density information of the image to be printed.

6. The device according to claim 1, wherein the collection member is a collection roller.

7. The device according to claim 1, wherein the external additive provides at least a charging assisting effect.

8. The device according to claim 1, wherein toner contains toner mother particles to which at least an external additive that provides a polishing effect is added.

9. The device according to claim 1, wherein toner contains toner mother particles to which at least an external additive that provides a polishing effect and an external additive that provides a charging assisting effect are added.

10. An image forming apparatus comprising at least:

an image carrier, an electrostatic latent image and a toner image being to be formed thereon;

a charging device for electrically charging the image carrier;

an exposure unit for writing an electrostatic latent image on the image carrier by exposing it to light;

a development unit for developing the electrostatic latent image on the image carrier by means of toner containing toner mother particles and an external additive added thereto and forming the toner image on the image carrier; and a transfer unit for transferring the toner image on the image carrier onto a transfer medium, and the charging device being a charging device according to claim 1.

11. A charging device comprising at least:

a first charging member held in contact with an image carrier, a toner image of toner containing toner mother particles and an external additive added thereto being to be formed thereon, a bias showing a polarity same as that of the charged potential of toner being to be applied thereto;

a second charging member arranged downstream relative to the first charging member as viewed in the moving direction of the image carrier and held in contact with the image carrier, a bias showing a polarity opposite to the charged potential of toner being to be applied thereto;

a collection member held in contact with the second charging member to collect the toner adhering to the second charging member, a bias being to be applied thereto; and a collection member bias control unit for controlling the bias to be applied to the collection member according to image forming unit service life information.

12. The device according to claim 11, wherein charging brush members are employed respectively for the first charging member and the second charging member.

13. The device according to claim 12, wherein at least the charging brush member of the second charging member is a brush roller.

14. The device according to claim 11, wherein the collection member is a collection roller.

15. The device according to claim 11, wherein the external additive provides at least a charging assisting effect.

16. The device according to claim 11, wherein toner contains toner mother particles to which at least an external additive that provides a polishing effect is added.

17. The device according to claim 11, wherein toner contains toner mother particles to which at least an external additive that provides a polishing effect and an external additive that provides a charging assisting effect are added.

18. An image forming apparatus comprising at least:

an image carrier to which an electrostatic latent image and a toner image being to be formed thereon;

a charging device for electrically charging the image carrier;

an exposure unit for writing an electrostatic latent image on the image carrier by exposing it to light;

a development unit for developing the electrostatic latent image on the image carrier by means of toner containing toner mother particles and an external additive added thereto; and a transfer unit for transferring the toner image on the image carrier onto a transfer medium, and the charging device being a charging device according to claim 11.

19. A method of charging an image carrier of an image forming apparatus comprising:

forming a toner image on the image carrier by means of toner containing toner mother particles and an external additive added thereto;

electrically charging a residual toner adhering to the image carrier after transferring the toner image formed on the image carrier by means of a first charging member, a bias showing a polarity same as that of the charged potential of toner being to be applied thereto;

seizing the toner left on the image carrier after the transfer and electrically charged by the first charging member by means of a second charging member, a bias showing a polarity opposite to that of the charged potential of toner being to be applied thereto;

collecting the toner seized by the second charging member by means of a collection member, a bias being to be applied thereto;

controlling a quantity of the external additive adhering to the second charging member after the passage of the collection member by controlling the bias to be applied to the collection member; and electrically charging the image carrier by means of the second charging member, the external additive adhering thereto by the controlled quantity.

* * * * *